US008516734B2

(12) United States Patent
Yale et al.

(10) Patent No.: US 8,516,734 B2
(45) Date of Patent: Aug. 27, 2013

(54) FIREARM SUPPORTING DEVICES, METHODS OF ASSEMBLING FIREARM SUPPORTING DEVICES, AND METHODS OF PACKAGING FIREARM SUPPORTING DEVICES

(71) Applicant: Battenfeld Technologies, Inc., Columbia, MO (US)

(72) Inventors: David Yale, Santa Clara, CA (US); Russell A. Potterfield, Columbia, MO (US); Tim Morrow, Jefferson City, MO (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 13/663,253

(22) Filed: Oct. 29, 2012

(65) Prior Publication Data

US 2013/0061564 A1 Mar. 14, 2013

Related U.S. Application Data

(62) Division of application No. 11/607,550, filed on Nov. 30, 2006, now Pat. No. 8,296,988.

(51) Int. Cl.
*F41C 27/00* (2006.01)

(52) U.S. Cl.
USPC ..... 42/94; 73/167

(58) Field of Classification Search
USPC ..... 42/90–94; 73/167
See application file for complete search history.

(56) References Cited

U.S. PATENT DOCUMENTS

| | | | | | |
|---|---|---|---|---|---|
| 2,817,233 | A * | 12/1957 | Dower et al. | 73/167 |
| 4,548,392 | A * | 10/1985 | Rickling | 269/156 |
| 4,998,944 | A * | 3/1991 | Lund | 42/94 |
| 5,058,302 | A * | 10/1991 | Minneman | 42/94 |
| 5,081,783 | A * | 1/1992 | Jarvis | 42/94 |
| 5,778,589 | A * | 7/1998 | Teague | 42/94 |
| 2004/0020097 | A1 * | 2/2004 | Deros | 42/94 |
| 2004/0134113 | A1 * | 7/2004 | Deros et al. | 42/94 |
| 2005/0115137 | A1 * | 6/2005 | Minneman | 42/94 |
| 2006/0218840 | A1 * | 10/2006 | Cauley | 42/94 |
| 2007/0074439 | A2 * | 4/2007 | Cauley et al. | 42/94 |
| 2007/0074440 | A2 * | 4/2007 | Cauley | 42/94 |
| 2007/0294929 | A1 * | 12/2007 | Potterfield et al. | 42/94 |
| 2008/0034636 | A1 * | 2/2008 | Potterfield et al. | 42/94 |
| 2008/0047189 | A1 * | 2/2008 | Potterfield et al. | 42/94 |
| 2008/0168697 | A1 * | 7/2008 | Potterfield et al. | 42/94 |
| 2009/0188146 | A1 * | 7/2009 | Werner | 42/94 |
| 2011/0094140 | A1 * | 4/2011 | Letson | 42/94 |

* cited by examiner

*Primary Examiner* — Samir Abdosh
(74) *Attorney, Agent, or Firm* — Senniger Powers LLP

(57) ABSTRACT

Firearm supporting devices (e.g., firearm vises), methods of assembling firearm supporting devices, and methods of packaging firearm supporting devices are disclosed herein. One aspect is directed to a firearm supporting device for supporting a firearm having a first section and a second section spaced apart from the first section. In one such embodiment, a firearm supporting device includes a base, a first support for carrying the first section of the firearm, and a second support for carrying the second section of the firearm. The base includes a first portion and a second portion configured to be attached to the first portion. The first portion is fixed relative to the second portion when the first and second portions are attached. The first support is configured to project from the first portion of the base. The second support is configured to project from the second portion of the base.

4 Claims, 5 Drawing Sheets

FIREARM SUPPORTING DEVICES, METHODS OF ASSEMBLING FIREARM SUPPORTING DEVICES, AND METHODS OF PACKAGING FIREARM SUPPORTING DEVICES

CROSS-REFERENCE TO RELATED APPLICATION

This application is a divisional of U.S. patent application Ser. No. 11/607,550, filed Nov. 20, 2006, the disclosure of which is incorporated herein by reference in its entirety.

TECHNICAL FIELD

The present disclosure is directed to firearm supporting devices, methods of assembling firearm supporting devices, and methods of packaging firearm supporting devices.

BACKGROUND

Rifles, shotguns, and other firearms can be held by hand or placed in a standard shop vise for cleaning and maintenance. Although placing the firearm in a shop vise is more secure than holding the firearm with one hand, a shop vise has several drawbacks. For example, a standard shop vise has metal jaws or clamping surfaces that must be covered with a softer material to avoid damaging the firearm. Often these jaw coverings are either not installed or fall off the vise after installation, resulting in damage to the firearm. Moreover, a standard shop vise clamps the firearm at a single point on the firearm. Because the vise clamps the firearm at only one point, the pressure at this point to effectively hold and secure the firearm must often be so great that the vise damages the firearm.

To address these concerns, several conventional firearm vises have been developed that support a firearm at two different points. These firearm vises, however, are bulky devices with a large length and height. As a result, the firearm vises are expensive to ship because shipping rates are based in part on the volume of a package. Not only are conventional firearm vises expensive to ship, but they are also cumbersome to store and transport due to the bulky size. Accordingly, there exists a need to improve conventional firearm vises.

DETAILED DESCRIPTION

A. Overview

Figure 1:
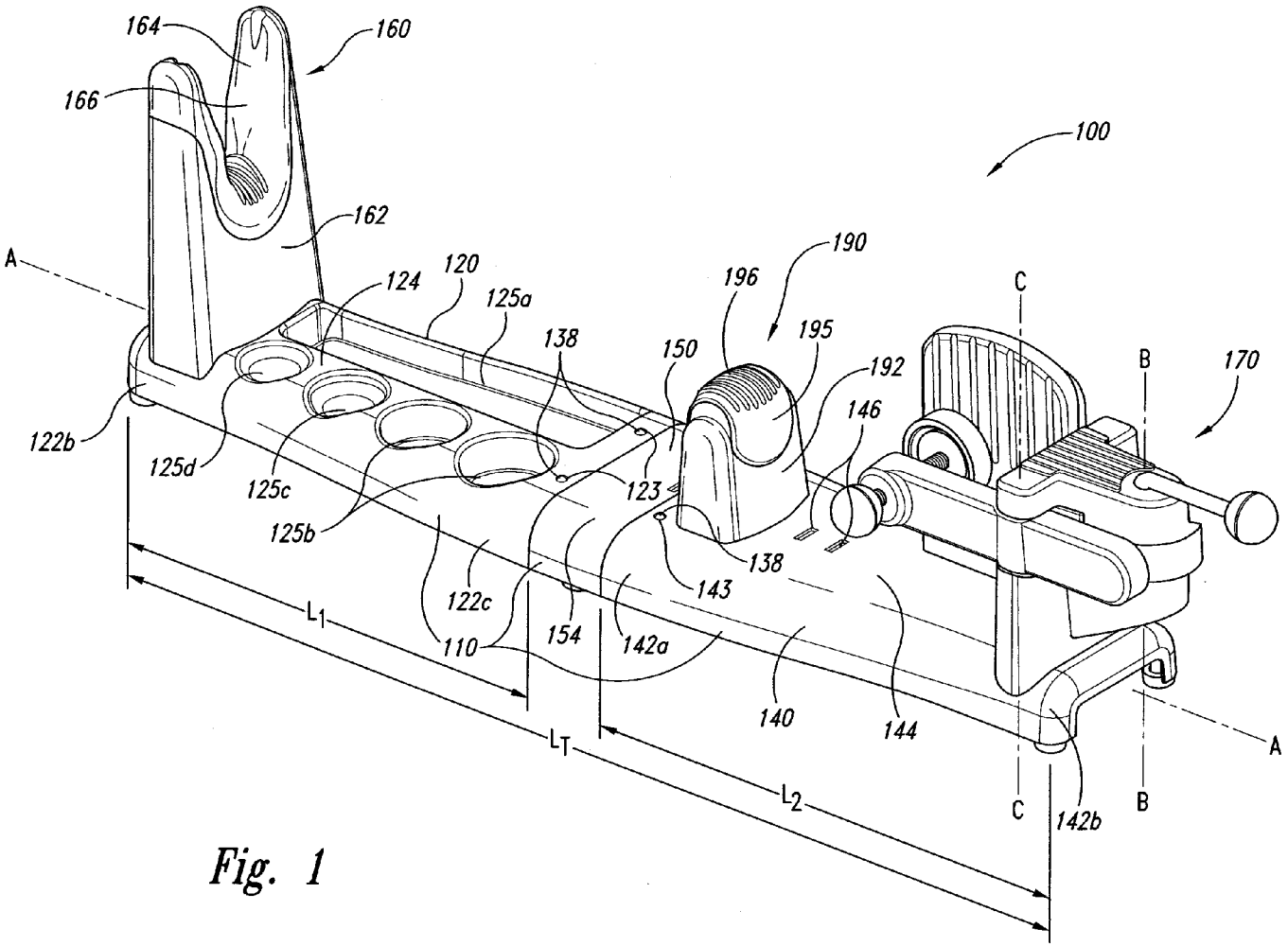
FIG. 1 is a schematic isometric view of a firearm supporting device in accordance with one embodiment of the invention.

The following disclosure describes several embodiments of firearm supporting devices (e.g., firearm vises), methods of assembling firearm supporting devices, and methods of packaging firearm supporting devices. One aspect of the invention is directed to a firearm supporting device for supporting a firearm having a first section and a second section spaced apart from the first section. In one embodiment, a firearm supporting device includes a base, a first support for carrying the first section of the firearm, and a second support for carrying the second section of the firearm. The base includes a first portion and a second portion configured to be attached to the first portion. The first portion is fixed relative to the second portion when the first and second portions are attached. The first support is configured to project from the first portion of the base. The second support is configured to project from the second portion of the base.

In another embodiment, a firearm supporting device includes a base having a first portion and a second portion attached to the first portion. The first portion has a first length and the second portion has a second length. The base has a minimum length greater than both the first and second lengths when the first portion is attached to the second portion. The supporting device further includes a first support attached to the first portion of the base and a second support attached to the second portion of the base. The first support is configured to support the first section of the firearm, and the second support is configured to support the second section of the firearm.

In another embodiment, a firearm supporting device includes a base having a first portion and a second portion attachable to the first portion. The supporting device further includes a first support attachable to the first portion and a second support attachable to the second portion. The first support is configured to support the first section of the firearm. The second support includes a clamp assembly having a cam and a cam follower positioned proximate to the cam. The clamp assembly is configured to contact the second section of the firearm and selectively inhibit movement of the second section of the firearm relative to the second portion of the base.

Another aspect of the invention is directed to methods of assembling firearm supporting devices for supporting firearms having a first section and a second section spaced apart from the first section. In one embodiment, a method includes attaching a first portion of a base to a second portion of the base such that the first portion is fixed along a longitudinal axis of the base relative to the second portion. The method further includes connecting a first support for carrying the first section of the firearm to the first portion of the base, and coupling a second support for carrying the second section of the firearm to the second portion of the base.

Another aspect of the invention is directed to methods of packaging firearm supporting devices for supporting firearms having a first section and a second section spaced apart from the first section. In one embodiment, a method includes providing a first portion of a base, a second portion of the base configured to attach to the first portion, a first support configured to project from the first portion and support the first section of the firearm, and a second support configured to project from the second portion and support the second section of the firearm. The method further includes placing the first and second portions of the base and the first and second supports in a container with the first and second portions of the base detached from each other.

Specific details of several embodiments of the invention are described below with reference to firearm supporting devices for supporting firearms. Several details describing well-known structures or processes often associated with firearms and firearm supporting devices are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-5. Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Firearm Supporting Devices

FIG. 1 is a schematic isometric view of a firearm supporting device 100 in accordance with one embodiment of the invention. The illustrated supporting device 100 can support and/or secure a firearm (e.g., a rifle or shotgun) at three points on the firearm for cleaning, maintenance, repair, modification, or other purposes. Specifically, the illustrated supporting device 100 includes a base 110, a first support 160 for carrying a forward section of the firearm, a second support 170 for carrying a rearward portion of the firearm, and a third support 190 for carrying an intermediate section of the firearm. For example, the first support 160 can support the forestock of a rifle, the second support 170 can support the buttstock of the rifle, and the third support 190 can support the stock of the rifle behind the trigger guard. In other embodiments, however, the supporting device 100 may not include the third support 190.

The illustrated base 110 has a longitudinal axis A-A, a first portion 120 attached to the first support 160, a second portion 140 attached to the second support 170, and a third portion 150 attached to and positioned between the first and second portions 120 and 140. The first, second, and third portions 120, 140, and 150 are separate and distinct components of the base 110 that can be assembled and attached together for use. For example, in several embodiments, the first, second, and third portions 120, 140, and 150 are configured to be releasably connected such that the portions 120, 140, and 150 can be detached from each other for storage, transport, shipping, or other purposes. In other embodiments, the first, second, and third portions 120, 140, and 150 can be configured to be non-releasably attached together such that the portions 120, 140, and 150 are assembled together and not disconnected. In either case, when the first, second, and third portions 120, 140, and 150 are attached together, the portions 120, 140, and 150 are fixed and non-movable relative to each other.

The first portion 120 of the base 110 has a length $L_1$, a longitudinal axis generally coaxial with the axis A-A of the base 110, a first end section 122*a* attached to the third portion 150, a second end section 122*b* opposite the first end section 122*a*, and an upper surface 124. The illustrated upper surface 124 includes numerous cavities, depressions, or recesses of specific sizes and shapes corresponding to common firearm cleaning supplies and maintenance tools. For example, the upper surface 124 includes a rectangular cavity 125*a* having a generally flat bottom surface, two deep circular cavities 125*b* having generally flat bottom surfaces, a circular cavity 125*c* having a curved bottom surface, and a shallow circular cavity 125*d* with a generally flat bottom surface. The rectangular cavity 125*a* is sized and shaped to receive rectangular bottles and/or cleaning patches; the deep circular cavities 125*b* are sized and shaped to receive round solvent bottles; and the circular cavities 125*c-d* provide storage for small parts, such as screws. In other embodiments, the first portion 120 may not include the cavities 125, and/or the first portion 120 can have a different configuration.

The second portion 140 of the base 110 includes a length $L_2$, a longitudinal axis generally coaxial with the axis A-A of the base 110, a first end section 142*a* attached to the third portion 150, a second end section 142*b* opposite the first end section 142*a*, and an upper surface 144. The upper surface 144 is generally coplanar with the upper surface 124 of the first portion 120 and an upper surface 154 of the third portion 150. The length $L_2$ of the second portion 140 and the length $L_1$ of the fist portion 120 are each less than a total length $L_T$ of the base 110 when the first and second portions 120 and 140 are attached together.

Figure 2:
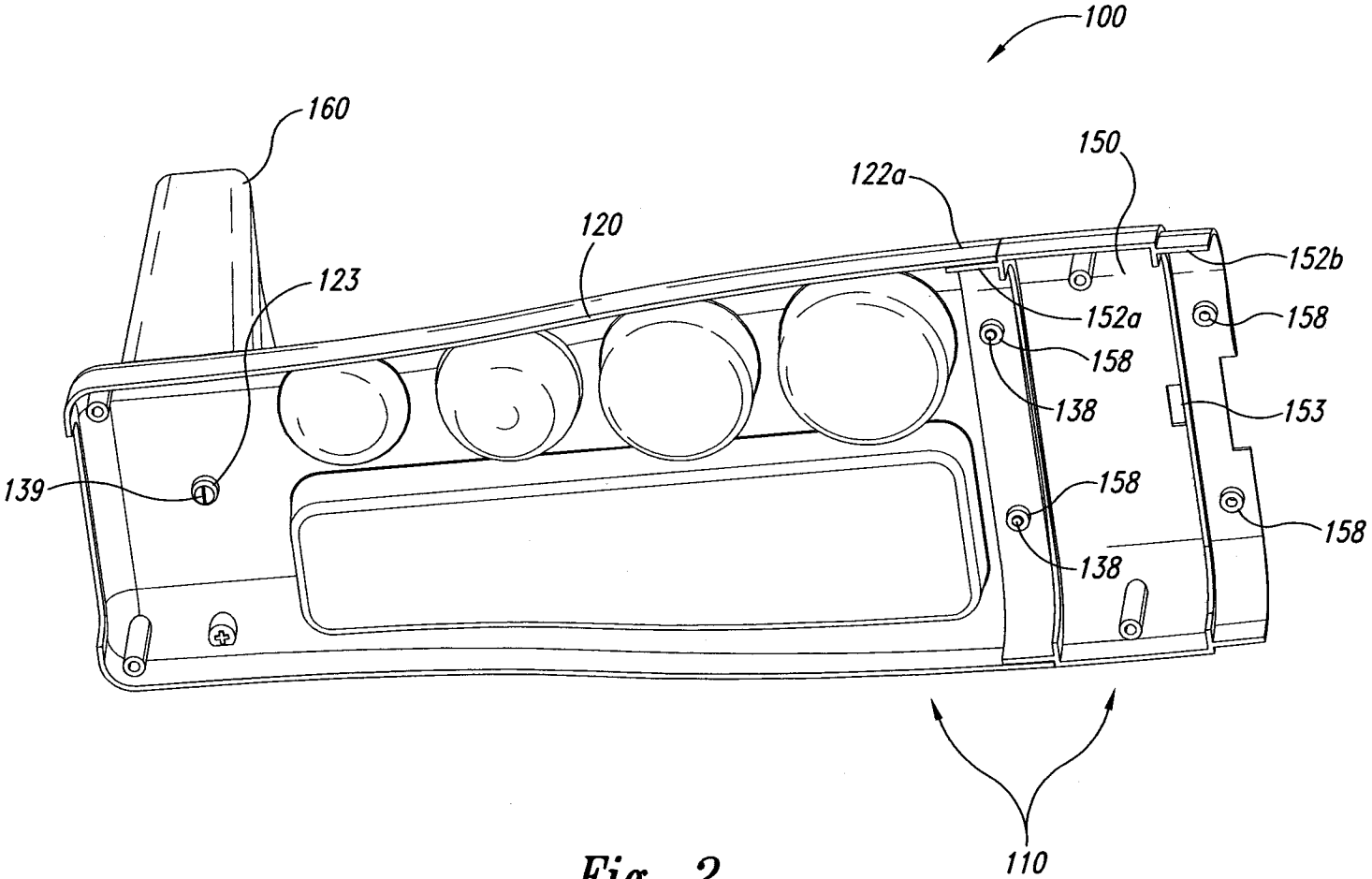
FIG. 2 is a schematic rear isometric view of the firearm supporting device with the second portion of the base removed to illustrate the connection between the first, second, and third portions of the base in accordance with one embodiment of the invention.

FIG. 2 is a schematic rear isometric view of the firearm supporting device 100 with the second portion 140 of the base 110 removed to illustrate the connection between the first, second, and third portions 120, 140, and 150 of the base 110 in accordance with one embodiment of the invention. The illustrated third portion 150 includes a first flange 152*a* and a second flange 152*b* opposite the first flange 152*a*. The first and second flanges 152*a-b* are recessed from the upper surface 154 (FIG. 1) and configured to interface with the first end sections 122*a* and 142*a* of the first and second portions 120 and 140, respectively. More specifically, when the first portion 120 is attached to the third portion 150, the first end section 122*a* is placed on the first flange 152*a* so that a plurality of apertures 123 (FIG. 1) in the first portion 120 are aligned with corresponding apertures 158 in the first flange 152*a*. Fasteners 138 can be placed in the apertures 123 and 158 to releasably attach the first portion 120 to the third portion 150. For example, the fasteners 138 can be bolts to which nuts may be attached. Alternatively, the apertures 158 in the first flange 152*a* can be sized to receive threaded bushings that are mounted to the third portion 150, and the fasteners 138 can interface with the threaded bushings. In either case, the fasteners 138 can be selectively removed with a tool or by hand without tools to decouple the first and third portions 120 and 150.

Referring back to FIG. 1, the illustrated second portion 140 is attached to the third portion 150 in a manner similar to the connection between the first and third portions 120 and 150. For example, the first end section 142*a* of the second portion 140 is placed on the second flange 152*b* (FIG. 2), and a plurality of fasteners 138 are received in apertures 143 in the second portion 140 and corresponding apertures 158 (FIG. 2) in the third portion 150. In other embodiments, the first, second, and third portions 120, 140, and 150 can be releasably attached via other mechanisms. In additional embodiments, the firearm supporting device 100 may not include the third portion 150, but rather the first and second portions 120 and 140 can be attached directly to each other. For example, in one such embodiment, the first or second portion 120 or 140 can include a flange that interfaces with the end section of the other portion.

The first support 160 is attached to the first portion 120 of the base 110 at the second end section 122*b* and projects from the upper surface 124. The first support 160 can be either (a) detachably coupled to the first portion 120 such that the first support 160 may be decoupled from the base 110, or (b) non-removably attached to the first portion 120 such that the first support 160 is configured to be attached to and not removed from the base 110. For example, in the illustrated embodiment, the first support 160 includes a threaded bushing (not shown), the first portion includes an aperture 123 (FIG. 2), and a fastener 139 (FIG. 2) is received in the aperture 123 and interfaces with the threaded bushing to releasably couple the first support 160 to the first portion 120. In other embodiments, the first support 160 can be an integral part of the first portion 120.

The illustrated first support 160 includes a body 162, a non-marring member 164 attached to the body 162, and a contact surface 166 on the non-marring member 164. The non-marring member 164 can be a pliable, rubber-like material to prevent marring of the firearm and provide a slip-resistant contact surface 166. The body 162 and non-marring member 164 can have a V-shaped configuration sized to receive the forward portion of the firearm. The V-shaped configuration centers the firearm and inhibits side-to-side movement of the firearm. In other embodiments, the first support 160 may have other configurations. For example, the first support 160 may have a height adjustment mechanism to change the distance between the contact surface 166 and the base 110. Moreover, the first support 160 may be movably attached to the first portion 120 and movable between two or more positions along the axis A-A of the base 110.

Figure 3:
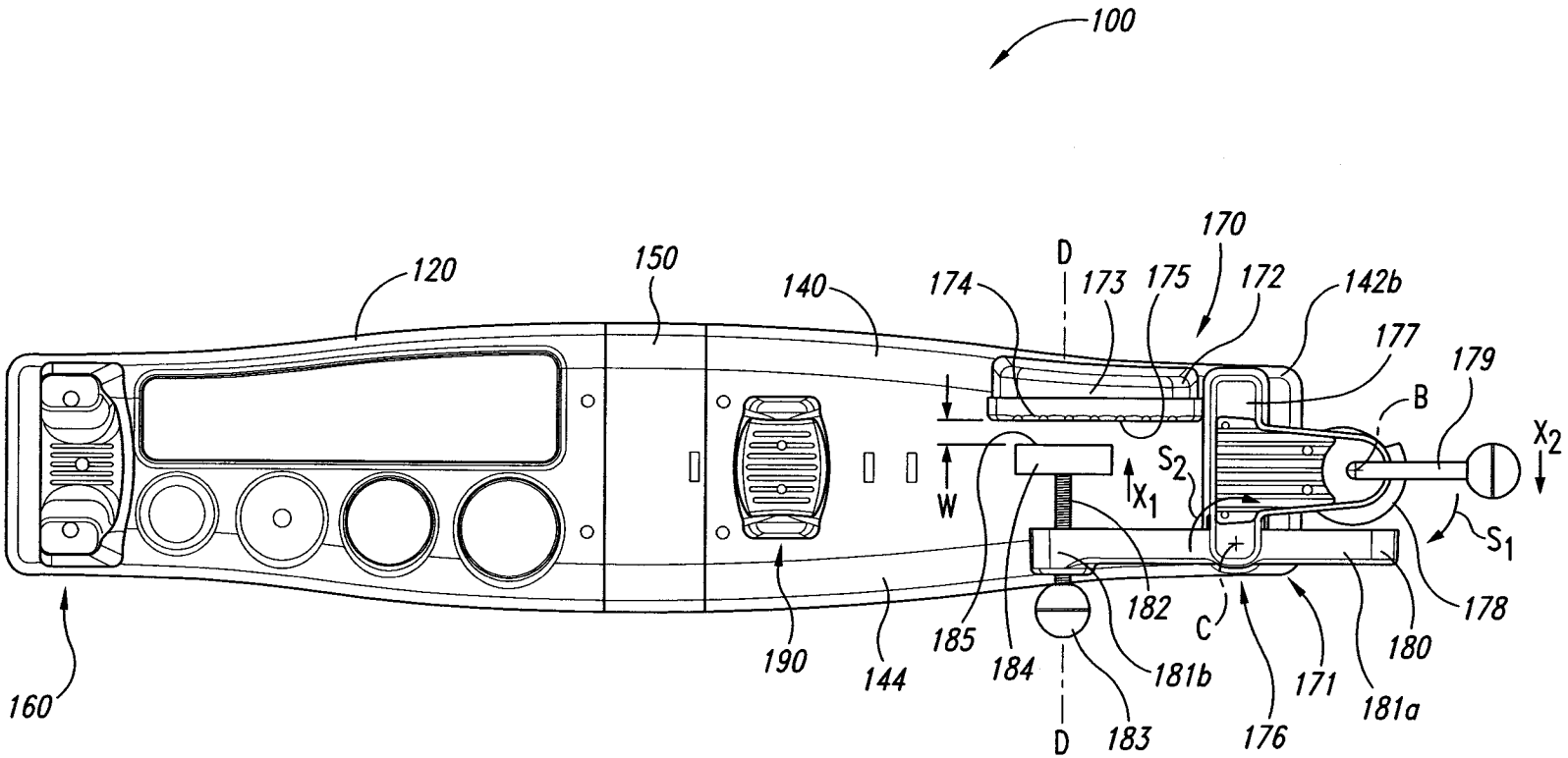
FIG. 3 is a schematic top plan view of the firearm supporting device of FIG. 1.

FIG. 3 is a schematic top plan view of the firearm supporting device 100 of FIG. 1. The second support 170 is coupled to the second portion 140 of the base 110 at the second end section 142*b* and projects from the upper surface 144. The illustrated second support 170 includes a clamping assembly 171 configured to selectively grasp a rearward portion (e.g., buttstock) of a firearm and inhibit movement of the firearm relative to the second portion 140 of the base 110. The clamping assembly 171 has a non-movable portion 172 and a movable portion 176 movable relative to the non-movable portion 172. The non-movable portion 172 includes a body 173, a non-marring member 174 attached to the body 173, and a contact surface 175 on the non-marring member 174. The body 173 can be detachably coupled or non-removably attached to the second portion 140 as described above with reference to the first support 160. Alternatively, the body 173 can be an integral component of the second portion 140. In either case, the illustrated body 173 and the non-marring member 174 are fixed (i.e., non-movable) relative to the second portion 140 when the non-movable portion 172 is attached to the second portion 140. In additional embodiments, both the non-movable portion 172 and the movable portion 176 can be movable relative to the second portion 140.

The movable portion 176 of the clamping assembly 171 includes a body 177, a cam 178 pivotably attached to the body 177 and rotatable about an axis B, a lever 179 attached to the cam 178, and a cam follower 180 pivotably attached to the body 177 and rotatable about an axis C. The body 177 can be detachably coupled or non-removably attached to the second portion 140 as described above with reference to the first support 160. The cam follower 180 has a first end portion 181*a* positioned to contact the cam 178 and a second end portion 181*b* opposite the first end portion 181*a*. The movable portion 176 further includes a threaded shaft 182, a handle 183 attached to one end of the threaded shaft 182, a contact member 184 attached to the other end of the threaded shaft 182, and a contact surface 185 on the contact member 184. The threaded shaft 182 interfaces with the second end portion 181*b* of the cam follower 180 such that rotation of the handle 183 about an axis D-D drives the contact member 184 in a direction $X_1$. As such, a user can adjust a distance W between the contact surfaces 175 and 185 to correspond to the size of the rearward portion of a particular firearm.

The movable portion 176 is movable between (a) a first position (shown in FIG. 3) in which the clamping assembly 171 releases the firearm and the firearm can be removed from the second support 170, and (b) a second position (not shown) in which the clamping assembly 171 clamps the firearm. A user can move the movable portion 176 from the first position to the second position by pushing the lever 179 in a direction $X_2$, which pivots the cam 178 in a direction $S_1$ about the axis B, which in turn pivots the cam follower 180 in a direction $S_2$ about the axis C, which drives the threaded shaft 182 and the contact member 184 in the direction $X_1$. The cam 178 may include a detent to retain the cam 178 and the movable portion 176 in the second position until the user exerts a force on the lever 179 to pivot the cam 178 back to the first position. In other embodiments, the second support 170 can have other configurations that may or may not include a clamping assembly. For example, the second support 170 may have a height adjustment mechanism to change the distance between the contact surfaces 175 and 185 and the base 110. Moreover, the second support 170 may be movably attached to the second portion 140 and movable between two or more positions along the axis A-A of the base 110.

Figure 4:
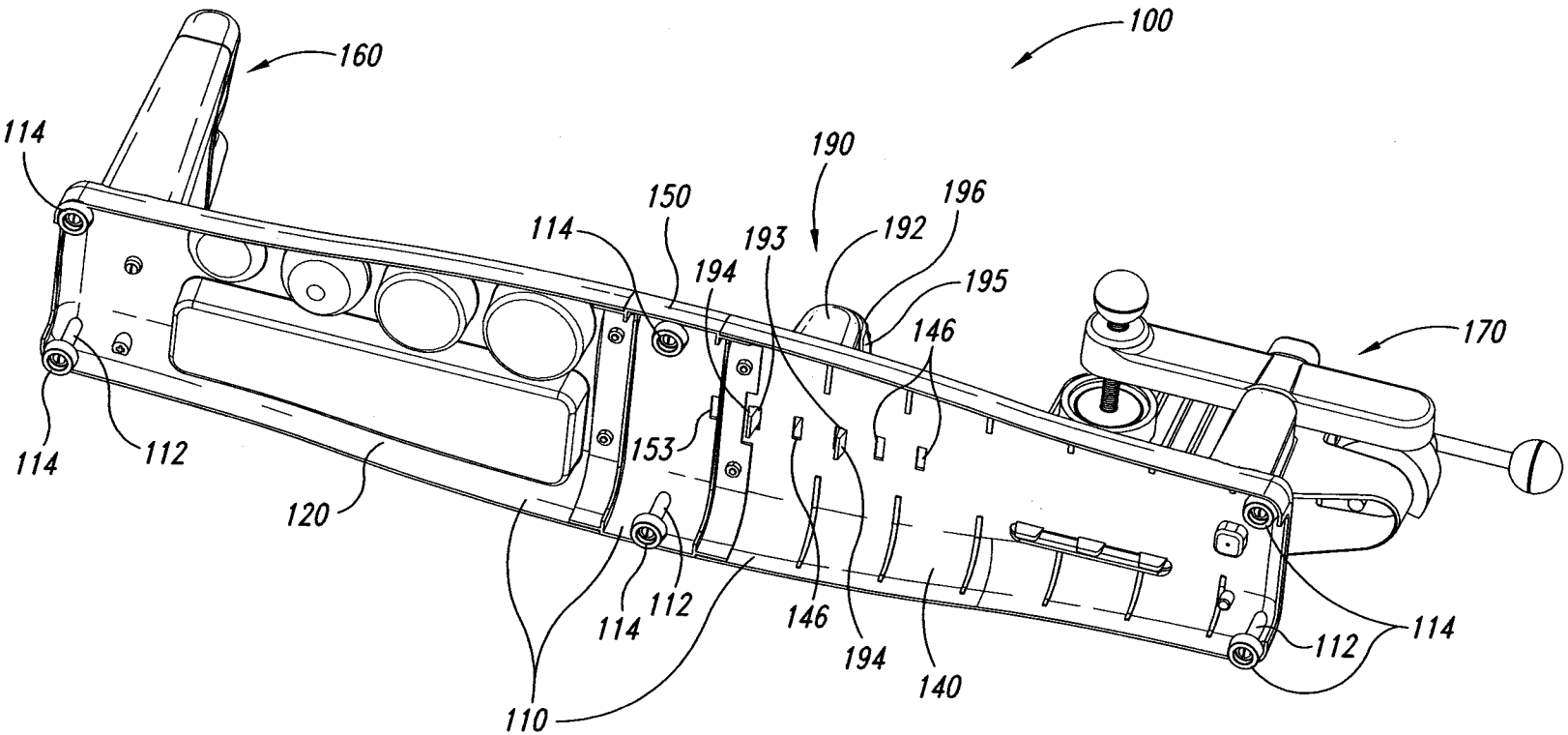
FIG. 4 is a schematic rear isometric view of the firearm supporting device of FIG. 1.

FIG. 4 is a schematic rear isometric view of the firearm supporting device 100 of FIG. 1. Referring to both FIGS. 1 and 4, the third support 190 includes a body 192, a non-marring member 195 attached to the body 192, and a contact surface 196 on the non-marring member 195 that is positioned to contact the firearm. The illustrated third support 190 can be removably connected to the second and/or third portion 140 and/or 150 of the base 110 at one of several different positions. Specifically, the second portion 140 includes a plurality of apertures 146 at the first end section 142*a*, the third portion 150 includes an aperture 153 generally aligned with the apertures 146, and the body 192 of the third support 190 includes two arms 193 sized to be received in a corresponding pair of apertures 146 and/or 153. The individual arms 193 can include a head 194 at the distal end that inhibits the third support 190 from inadvertently decoupling from the base 110. For example, the heads 194 can project from the arms 193 and contact the second and/or third portions 140 and/or 150 adjacent to the apertures 146 and/or 153 to inhibit the arms 193 from sliding out of the apertures 146 and/or 153. A user can press the two arms 193 toward each other to selectively detach the third support 190 from the base 110. The user can accordingly attach the third support 190 to the base 110 at any one of a plurality of positions to accommodate firearms with different sizes and/or configurations. In additional embodiments, the firearm supporting device 100 may not include the third support 190, or the third support 190 can have a different configuration.

The illustrated base 110 further includes a plurality of projections 112 and a plurality of feet 114 attached to corresponding projections 112. The projections 112 can include threaded bushings that receive corresponding threaded shafts of the feet 114. As such, in several applications, the feet 114 can be detached from the base 110 and fasteners can attach the base 110 to a table. For example, the fasteners can project from a surface of the table and threadably engage the bushings in corresponding projections 112. The feet 114 may include a non-skid material to inhibit movement of the base 110 relative to an external support surface on which the firearm supporting device 100 rests.

The first, second, and third portions 120, 140, and 150 of the base 110 can be manufactured as separate components by injection molding or other suitable processes. After manufacturing, the first, second, and third portions 120, 140, and 150 can be placed in a container (e.g., a box) along with the first, second, and third supports 160, 170, and 190 and shipped to a customer, distributor, or store for retail sale. An advantage of the illustrated firearm supporting device 100 is that the components may be packaged and shipped, stored, and/or transported in a disassembled state. For example, the first, second, and third portions 120, 140, and 150 of the base 110 and the first, second, and third supports 160, 170, and 190 can be placed in a shipping container with the components detached from each other. This is expected to reduce the cost to ship the supporting device 100 because shipping rates are based in part on the volume of the package. In other embodiments, however, the device 100 can be stored and/or packaged and shipped with some or all of the components attached.

C. Additional Embodiments of Firearm Supporting Devices

Figure 5:
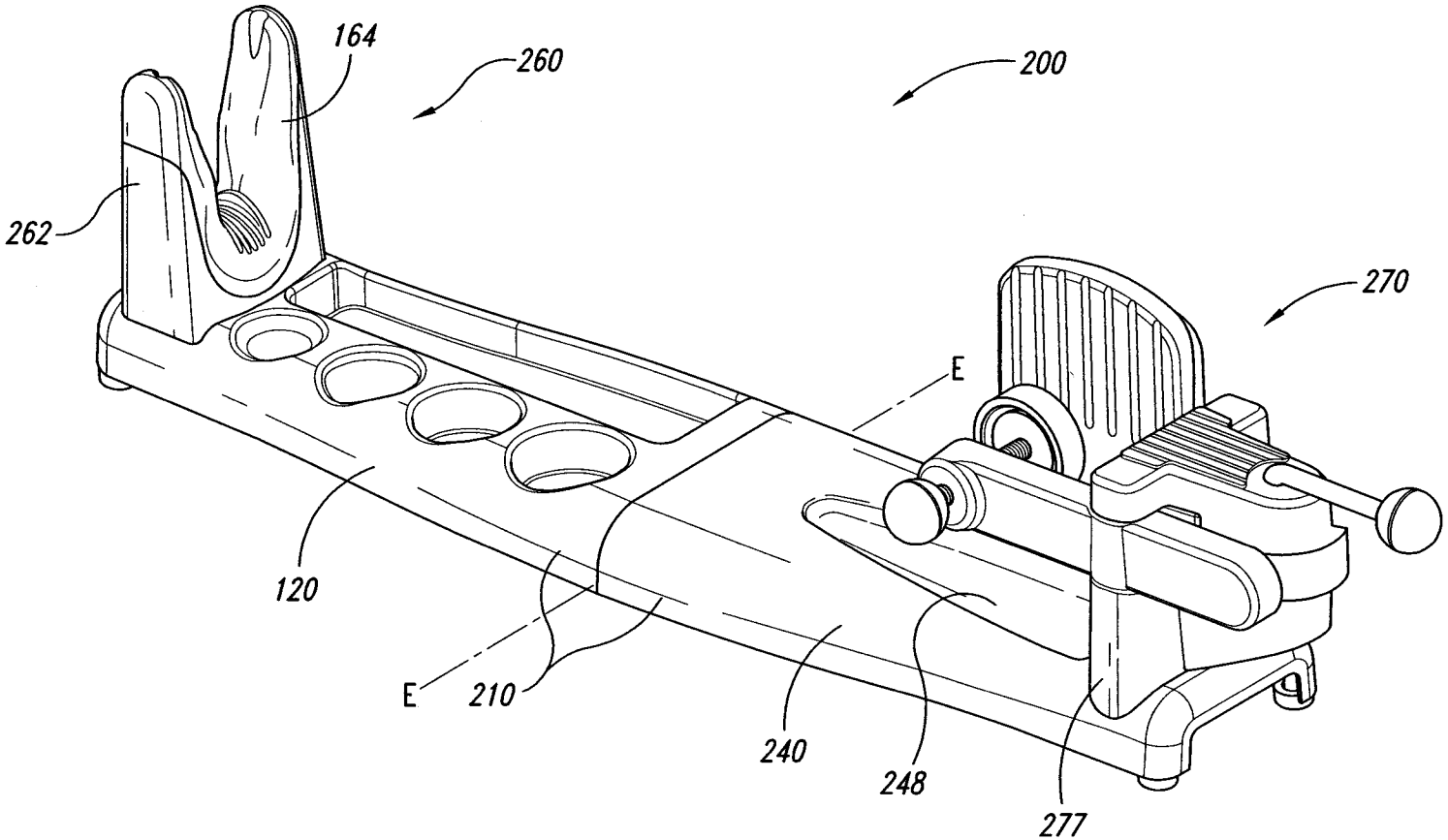
FIG. 5 is a schematic isometric view of a firearm supporting device in accordance with another embodiment of the invention.

FIG. 5 is a schematic isometric view of a firearm supporting device 200 in accordance with another embodiment of the invention. The firearm supporting device 200 is generally similar to the firearm supporting device 100 described above with reference to FIGS. 1-4. For example, the illustrated device 200 includes a base 210, a first support 260 attached to the base 210, and a second support 270 attached to the base 210. The illustrated device 200, however, does not include a third support attached to the base 210. In additional embodiments, the device 200 may include a third support attached to the base 210 for supporting the firearm. In either case, the illustrated base 210 includes a first portion 120 and a second portion 240 attached directly to the first portion 120. As such, the base 210 does not include a third portion positioned between the first and second portions 120 and 240. In one embodiment, the first and second portions 120 and 240 can be attached together with a hinge such that the portions 120 and 240 can pivot toward each other about an axis E for storage, shipping, or transport. In additional embodiments, however, the base 210 may have other configurations including a handle for carrying the device 200 and/or a third portion attached between the first and second portions 120 and 240. The illustrated second portion 240 includes a recess 248 sized to partially receive the rearward portion of the firearm. For example, the illustrated recess 248 is sized and configured to partially receive the buttstock of a rifle. Because a portion of the firearm is received in the recess 248, the body 262 of the first support 260 and the body 277 of the second support 270 can have a reduced height relative to the corresponding supports on the firearm supporting device 100 described above with reference to FIGS. 1-4. The reduced height of the first and second supports 260 and 270 advantageously reduces the height or profile of the device 200. In additional embodiments, the first and/or second supports 260 and 270 can be pivotably coupled to the base 210 and movable between a deployed position (shown in FIG. 5) and a stowed position (not shown) in which the supports 260 and 270 are folded against the base 210.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A method of packaging a firearm supporting device for supporting a firearm having a first section and a second section spaced apart from the first section, the method comprising:

providing a first portion of a base, a second portion of the base configured to attach to the first portion, a first support configured to project from the first portion of the base and support the first section of the firearm, and a second support configured to project from the second portion of the base and support the second section of the firearm; and placing the first and second portions of the base and the first and second supports in a container with the first and second portions of the base detached from each other;

wherein placing the first and second portions of the base in the container comprises positioning the first and second supports in the container with the first support detached from the first portion of the base and the second support detached from the second portion of the base.

2. A method of packaging a firearm supporting device for supporting a firearm having a first section and a second section spaced apart from the first section, the method comprising:

providing a first portion of a base, a second portion of the base configured to attach to the first portion, a first support configured to project from the first portion of the base and support the first section of the firearm, and a second support configured to project from the second portion of the base and support the second section of the firearm; and placing the first and second portions of the base and the first and second supports in a container with the first and second portions of the base detached from each other;

further comprising molding the first and second portions of the base and the first and second supports.

3. The method of claim 1 wherein providing the first and second portions of the base comprises providing a first portion having a first length and a second portion having a second length, wherein the first and second lengths are less than a minimum length of the base when the first and second portions are attached together.

4. The method of claim 2 wherein providing the first and second portions of the base comprises providing a first portion having a first length and a second portion having a second length, wherein the first and second lengths are less than a minimum length of the base when the first and second portions are attached together.

* * * * *